United States Patent [19]

Jacobson

[11] Patent Number: 5,031,317

[45] Date of Patent: Jul. 16, 1991

[54] RAZOR

[75] Inventor: Chester F. Jacobson, Southboro, Mass.

[73] Assignee: The Gillette Co., Boston, Mass.

[21] Appl. No.: 585,258

[22] Filed: Sep. 19, 1990

[51] Int. Cl.[5] ..... B26B 21/00; B26B 19/26; B26B 21/22

[52] U.S. Cl. ..... 30/49; 30/42; 30/50

[58] Field of Search ..... 30/49, 50, 41, 32, 346.5, 30/34.1, 34.2, 45, 347

[56] References Cited

U.S. PATENT DOCUMENTS

| | | | |
|---|---|---|---|
| 2,632,242 | 3/1953 | Musso | 30/49 |
| 3,702,026 | 11/1972 | Scholin | 30/49 |
| 4,057,896 | 11/1977 | Trotta | 30/89 |
| 4,198,746 | 4/1980 | Trotta | 30/47 |
| 4,294,010 | 10/1981 | Chen et al. | 30/42 |
| 4,302,876 | 12/1981 | Emmett | 30/47 |
| 4,324,041 | 4/1982 | Trotta | 30/47 |
| 4,325,392 | 4/1982 | Iten et al. | 132/80 |
| 4,337,575 | 7/1982 | Trotta | 30/47 |
| 4,378,634 | 4/1983 | Jacobson | 30/47 |
| 4,574,476 | 3/1986 | Ortiz | 30/47 |
| 4,807,360 | 2/1989 | Cerier et al. | 30/49 |
| 4,875,288 | 10/1989 | Trotta et al. | 30/49 |
| 4,926,553 | 5/1990 | Miskin et al. | 30/49 |
| 4,964,214 | 10/1990 | Welsh et al. | 30/49 |

*Primary Examiner*—Douglas D. Watts
*Assistant Examiner*—Heyrana, Sr. Paul M.
*Attorney, Agent, or Firm*—Lorusso & Loud

[57] ABSTRACT

A razor having a base member, spring fingers extending from the base member, a plurality of razor blades, each of the razor blades having a generally tubular wall defining a central aperture, each of the razor blades having an integrally formed flange on a first end of the tubular wall, a free edge of each of the flanges comprising an annular cutting edge, a second end of the tubular wall having therein a plurality of the spring fingers extending into the aperture, such that the spring fingers within the tubular walls permit multi-directional movement of the razor blades responsive to pressures encountered during shaving operations.

28 Claims, 6 Drawing Sheets

RAZOR

BACKGROUND OF THE INVENTION

1. Field of the Invention

This invention relates to wet-shaving razors and is directed more particularly to a razor having means thereon for resiliently supporting blade means.

2. Description of the Prior Art

It is known in the art to provide razors in which there are tubular-shaped blades mounted on a resilient body member, such that the blades may move in response to forces encountered during a shaving operation.

One such shaving device is disclosed, for example, in U.S. Pat. No. 4,875,288, issued Oct. 24, 1989, in the name of Robert A. Trotta et al. The '288 device includes a plurality of blades, each blade comprising a tubular wall having an inwardly facing flange formed on one end and an outwardly facing flange formed on the other end. The inwardly facing flange of each blade has a sharpened cutting edge thereon. The outwardly facing flange of each blade rests upon a resilient foam pad member, or the like, which permits movement of the blades during shaving, to conform to the contour of a surface being shaved. A similar shaving device is disclosed in U.S. Pat. No. 4,807,360, issued Feb. 28, 1989 in the name of Jeffrey C. Cerier et al.

While the resilient pad member disclosed in the above-mentioned patents provides a resilient mounting for the blade members, it can absorb water during a shaving operation, and become heavy and, when pressure is applied, release undesirable quantities of water. A foam pad, of the type disclosed in the above-mentioned patents, also is difficult to rinse clean and, after a time, becomes a collection point for shaving debris.

Further, mounting blade members on a resilient foam pad renders the exercise of the pre-selected spring forces on the blade members a difficult and elusive problem.

SUMMARY OF THE INVENTION

It is, therefore, an object of the present invention to provide a razor having a base member on which are mounted tubular blade means of the type above described, the base member providing a resilient mounting for the blade means, the resilient mounting affording a pre-selected spring force on the blade means.

A further object of the invention is to provide such a razor in which the base member is readily rinseable and easily maintained in a clean condition.

A still further object of the invention is to provide such a razor in which the base member is such as not to absorb or collect water therein and is therefore incapable of discharging quantities of water upon application of pressure thereagainst.

A still further object of the invention is to provide such a razor in which the base member is provided with resilient protrusions and rigid protrusions, both molded integrally with the base member and providing means for mounting the blade means on the base member for movement during a shaving operation.

With the above and other objects in view, as will hereinafter appear, a feature of the present invention is the provision of a razor comprising a base member, spring finger means extending from the base member, a plurality of razor blades mounted on the base member, each of the razor blades having a generally tubular wall defining a central aperture, each of the razor blades having an integrally formed flange on a first end of the tubular wall, a free edge of each of the flanges comprising an annular sharpened cutting edge, a second end of the tubular wall having therein the spring finger means extending into the aperture, such that the spring finger means within the tubular walls permit movement of the razor blades responsive to pressures encountered during shaving operations.

A further feature of the invention is the provision of a base member for a razor, the base member having resilient protrusions, comprising the above-mentioned spring fingers, and rigid protrusions molded integrally with the base member and extending therefrom, the protrusions providing means for mounting the blades on the base member for movement during a shaving operation.

The above and other features of the invention, including various novel details of construction and combination of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention from which its novel features and advantages will be apparent.

In the drawings.

DESCRIPTION OF THE PREFERRED EMBODIMENT

Figure 1:
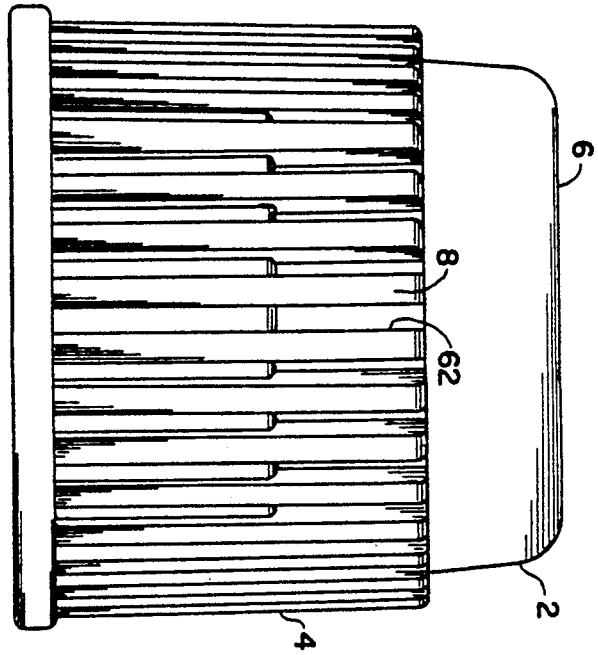
FIG. 1 is a side elevational view of a housing portion of an illustrative embodiment of the invention.
Figure 2:
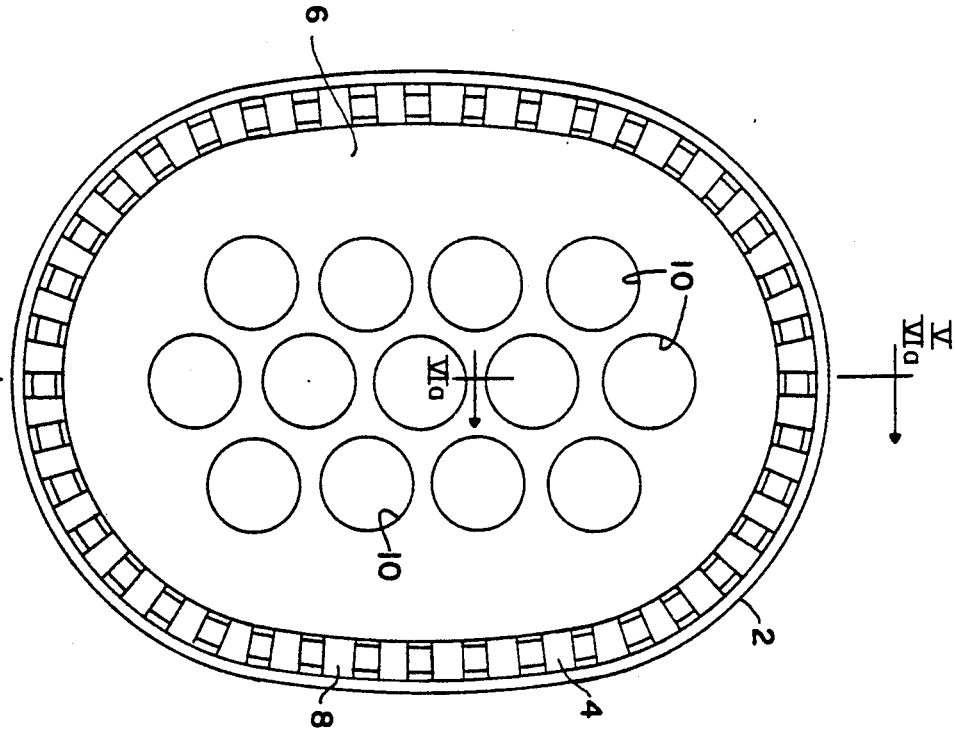
FIG. 2 is a top plan view of the housing of FIG. 1.

Referring to the drawings, particularly FIGS. 1, 2, 5 and 6, it will be seen that an illustrative razor includes a housing 2 having side walls 4 and a top wall 6. The side walls 4 are provided with elongated ribs 8 on the exterior thereof, which serve as grip means for the razor. The top wall 6 is provided with a series of holes 10. The housing 2 preferably is formed of a semi-rigid plastic material, such as polypropylene.

Referring to FIGS. 3-6, it will be seen that the illustrative razor further includes a base member 12 attached to and contained within the housing 2. An upper surface 11 of a top wall of the base member 12 and the housing top wall 6 are generally parallel to each other (FIG. 6) and spaced from each other. Resilient protrusions extend from the upper surface 11 of the base member 12 and comprise spring fingers 14 on which are mounted razor blades 16. Rigid protrusions 15 extend from the upper surface 11 of the base member 12, with the spring fingers 14 and the rigid protrusions 15 arranged around holes 17 in the base member surface 11. The holes 17 are aligned with the housing holes 10.

The base member 12 preferably is formed of a semi-rigid elastomeric material, such as nylon or acetal, impervious to water, and the spring fingers 14 and the rigid protrusions 15 are formed integrally therewith. As may be seen in FIGS. 3-5, though formed of the same material, the fingers 14 and the rigid protrusions 15 may be endowed with different resiliency characteristics because of their different configurations. The spring fingers 14 are relatively long and slender, compared to the relatively short and broad protrusions 15. Further, as will be described below, many of the protrusions 15 comprise two or three legs, which add to the rigidity of such protrusions.

Figure 6:
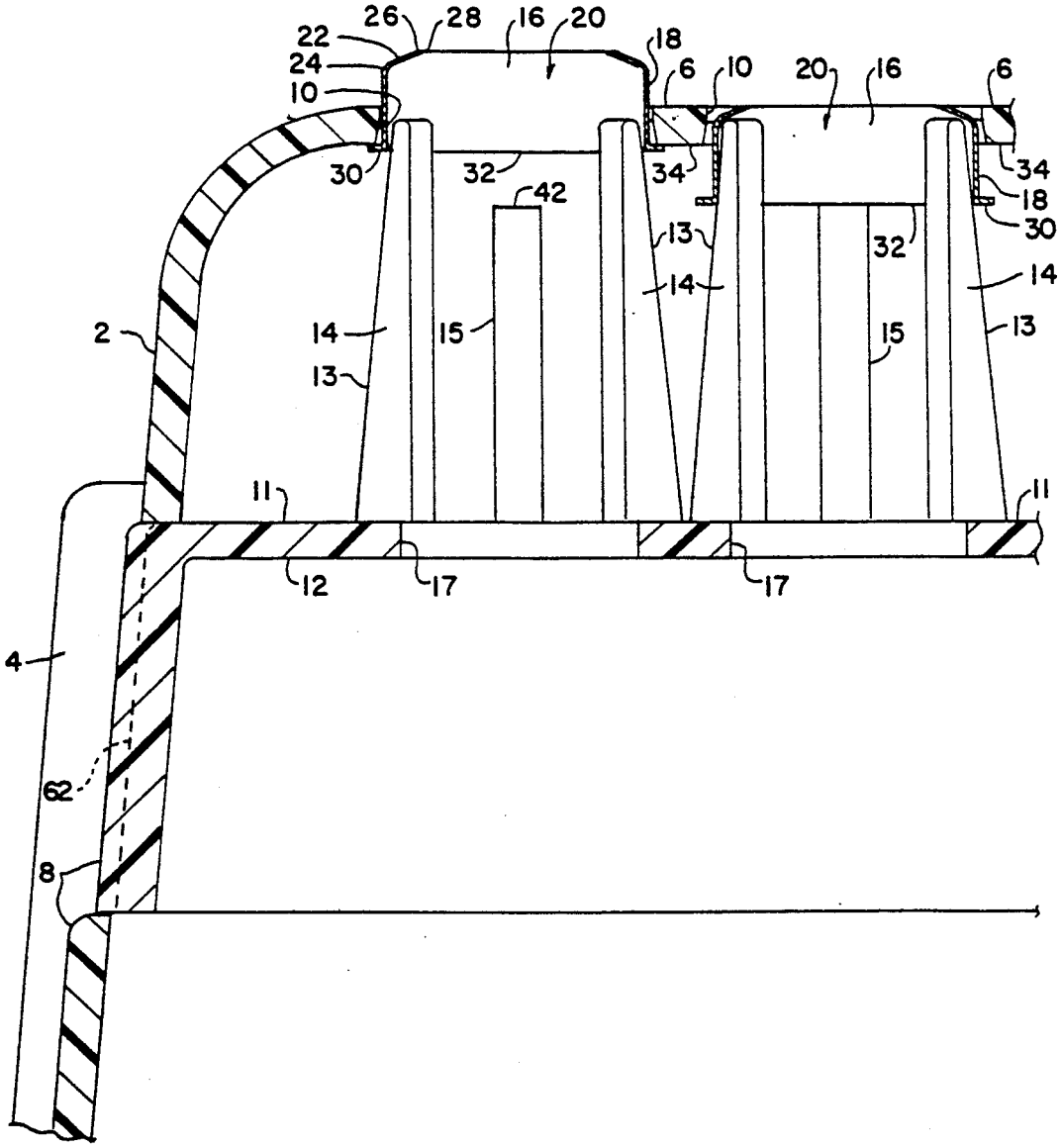
FIG. 6 is an enlarged view of a portion of the assembled housing, base member and blades, the base member taken in section along line VI—VI of FIG. 4 and the housing taken along line VIa—VIa of FIG. 2.

Each of the spring fingers 14 includes at least one edge, as the outboard edge 13 shown in FIG. 6, which inclines from a relatively broad base to a narrow, nearly pointed, free upper end.

Each of the blades 16 has a generally tubular wall 18 defining a central aperture 20 (FIG. 6) therethrough. An integrally formed first flange 22 extends inwardly from a first end 24 of the tubular wall 18 and has at a free edge 26 thereof an annular, inwardly-directed, cutting edge 28. An integrally formed second flange 30 extends outwardly from a second end 32 of the tubular wall 18. The second flange 30 is adapted to be disposed against an underside 34 of the top wall 6 of the housing 2. The blades 16 preferably are of metal, such as treated steel.

Figure 4:
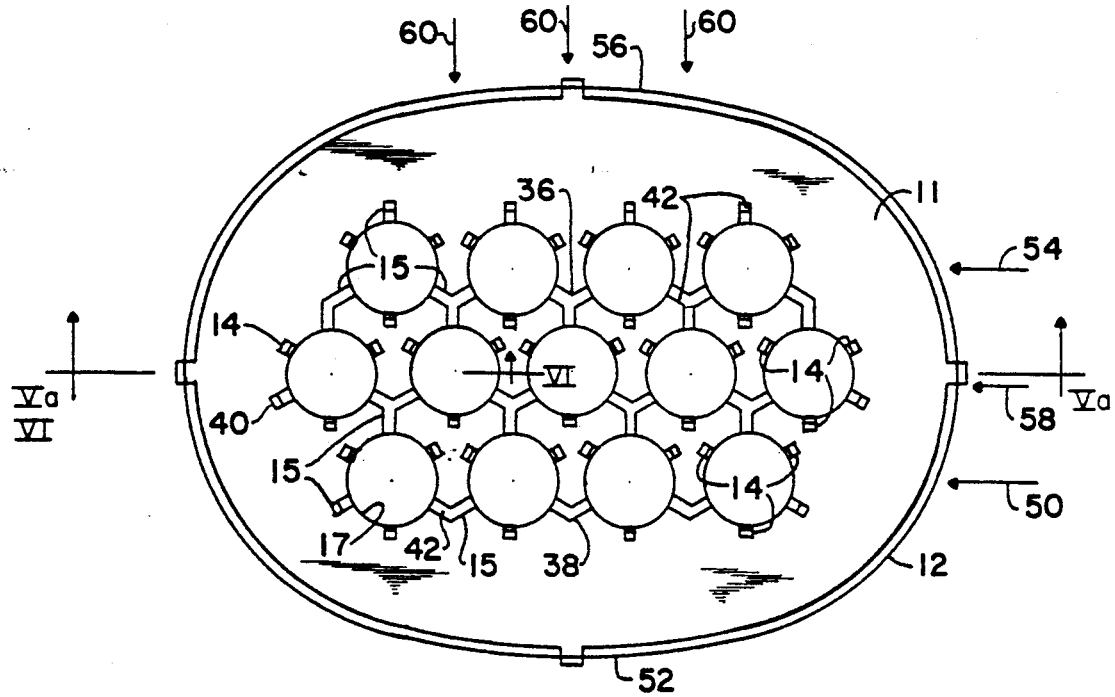
FIG. 4 is a top plan view of the base member of FIG. 3.
Figure 3:
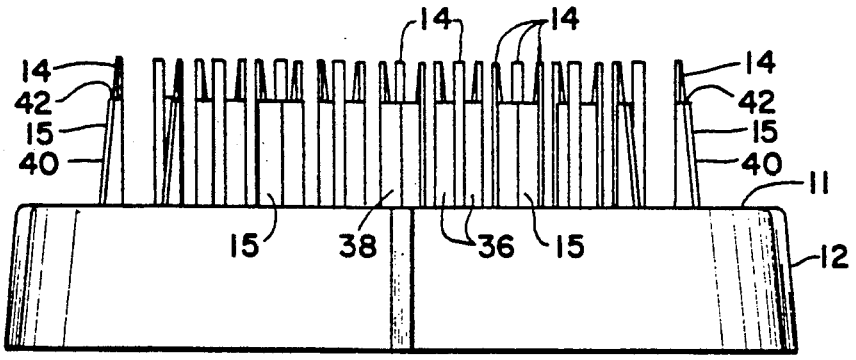
FIG. 3 is a side elevational view of a base member portion of the invention.
Figure 5:
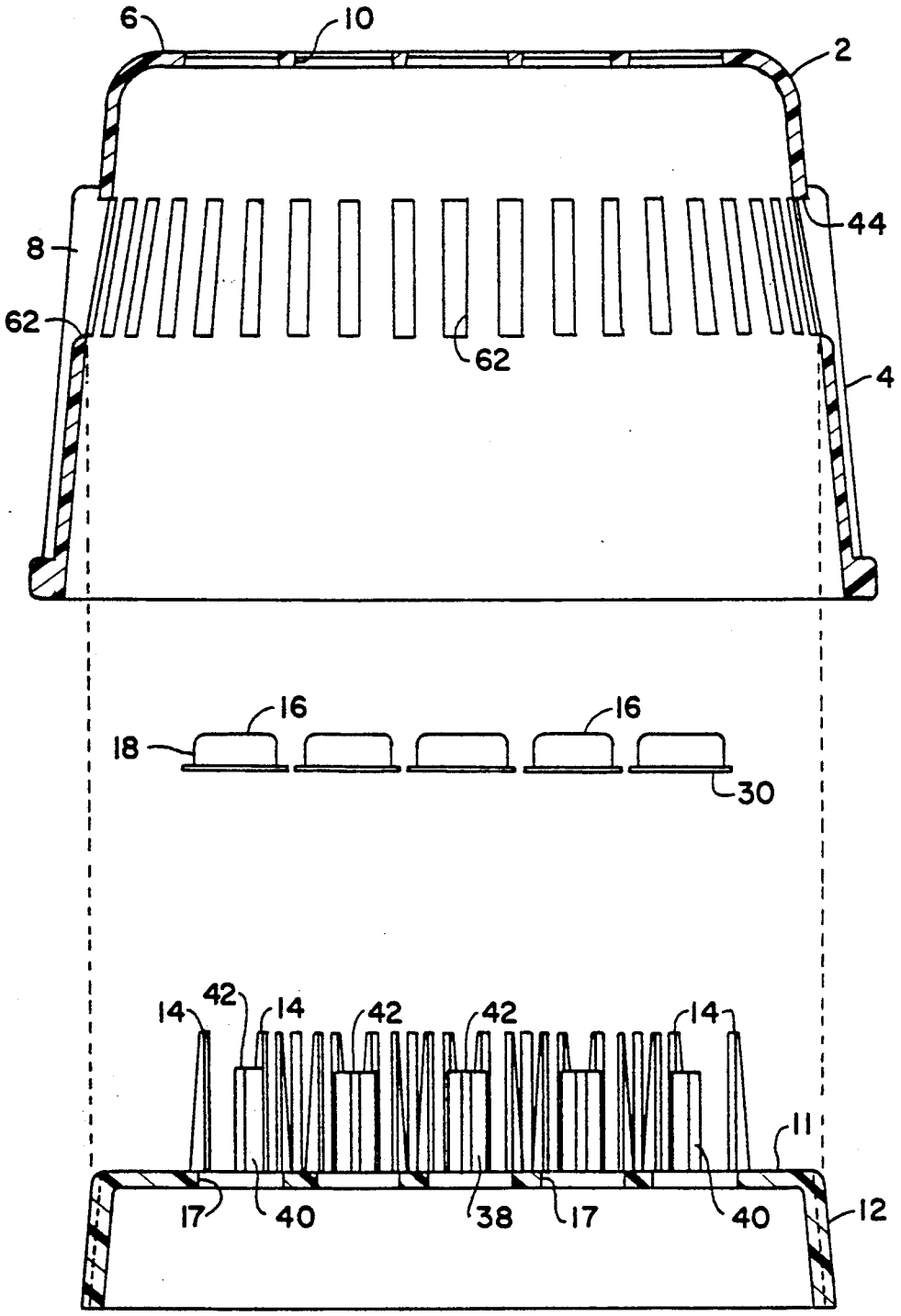
FIG. 5 is a side sectional exploded view of the housing, base member, and blades; the housing being viewed along line V—V of FIG. 2, the base member along line Va—Va of FIG. 4, and the blades in elevation.

The razor blades 16 are each disposed in one of the holes 10 in the housing top wall 6, with a number of the spring fingers 14 extending into the second end 32 of the blade. While three spring fingers 14 per blade is illustrated in the drawings, and found suitable in practice, other combinations of spring fingers may well occur to those skilled in the art. Referring particularly to FIGS. 3, 5 and 6, it will be seen that the spring fingers 14 and the rigid protrusions 15 are arranged around the holes 17 in alternating fashion. For economy and ease of molding, as well as for enhancing rigidity, a single Y-shaped rigid protrusion 36 (FIG. 4) may serve three blades, and a single angled protrusion 38 may serve two blades. Other rigid protrusions 40 are configured and adapted to serve one blade only.

It will be noted in FIGS. 3 and 6 that the rigid protrusions 15 are of less height than the spring fingers 14, and are provided with flat surfaces 42 at their free ends. The rigid protrusions free end flat surfaces 42 are adapted to receive thereon the second flanges 30 of the blades 16 (FIG. 6).

The base member top wall holes 17 may be provided in three rows. Referring to FIG. 4, it will be seen that the base member is provided with a first row 50 of the holes 17, the first row of holes being disposed in a line proximate a first side wall 52 of the base member. The base member is further provided with a second row 54 of holes, the second row of holes being disposed in a line proximate a second side wall 56 of the base member. The holes of the second row 54 are aligned with the holes of the first row 50 sidewise of the base member, that is, in a direction from the first side wall 52 to the second side wall 56. The base member is provided with a third row 58 of holes between the first and second rows 50,54, the third row of holes being offset from the holes of the first and second rows, such that the holes of the third row are at least in part disposed in paths 60 between the first and second row holes. The holes 10 of the top wall 6 of the hosing 2 are arranged in a similar fashion, such that each housing hole 10 is aligned with a base member hole 17.

In assembly, the blades 16 are mounted on the spring fingers 14, as illustrated in FIGS. 5 and 6, and the housing 2 and base member 12 brought together to trap the blades therebetween. The housing and base member side walls may simply "snap" together and be locked together by a detent arrangement (not shown). The blades 16 rest on the inclined outboard edges 13 of the spring finger 14, with the blades second flanges 30 engaging the underside 34 of the housing top wall 6.

The spring fingers 14 may be designed to afford a selected spring force on the blades 16 which they support. Knowing the material from which the spring fingers are to be made, the number and location of the spring fingers for each blade, as for example three fingers spaced 120° apart, and the configuration of the spring fingers, the dimensions of the spring fingers may be tailored to permit safe and efficient movement of the blades. Ideally, the blades are spring loaded by the spring fingers 14 to retract into the housing when a normal force on the blades exceeds 5 to 11 grams. The blades are movable reciprocally into the housing 2 and are also movable in a tilting fashion to accommodate to the contours of a surface being shaved.

During a shaving operation, the second flanges 30 retain the blades 16 in the holes 10, and the spring fingers 14 provide resilient support for the blades. When pressure is applied to a blade sufficient to overcome the resistance to flexure of the blade's supporting fingers 14, the fingers flex inwardly, permitting the blade to move downwardly in its hole 10. The extent of the blade movement downwardly into the housing 2 is limited by engagement of the blade second flange 30 with the flat surface 42 of the rigid protrusions 15. When pressure is eased on the blade, the fingers 14 tend to return to their unstressed state and, because of the inclined edges 13, cause the blade to ride upwardly, back into its more elevated position.

Figure 10:
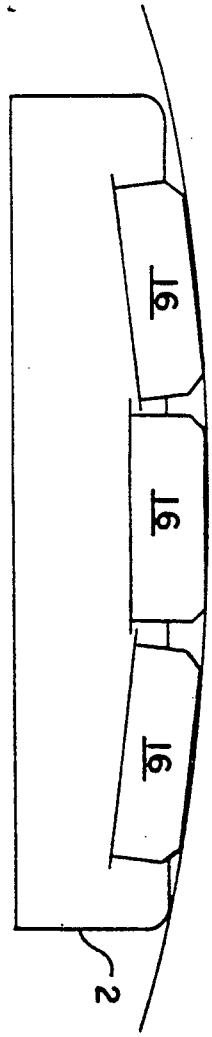
FIG. 10 is an end elevational diagrammatic view of the razor portion of FIG. 9 in operation against a concave surface.

Thus, the blade is able to move reciprocally and tiltingly during the shave, responding dynamically to the surface being shaved. The blades 16 are free to "float" above the housing top wall 6 such that collectively the blades conform to the area being shaved, be it convex (FIGS. 7 and 8) or concave (FIGS. 9 and 10). For a concave shaped area, the outer blades retract and the inner blades do not, and for the convex shaped area, the central blades retract and the outer blades either retract less or do not retract, depending upon the curvature.

Figure 8:
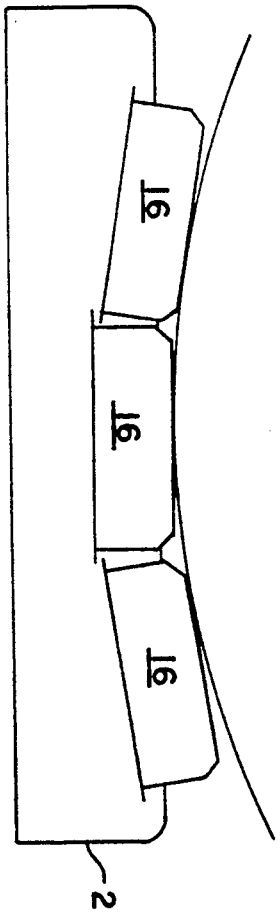
FIG. 8 is an end elevational diagrammatic view of the razor portion of FIG. 7 in operation against a convex surface.
Figure 7:
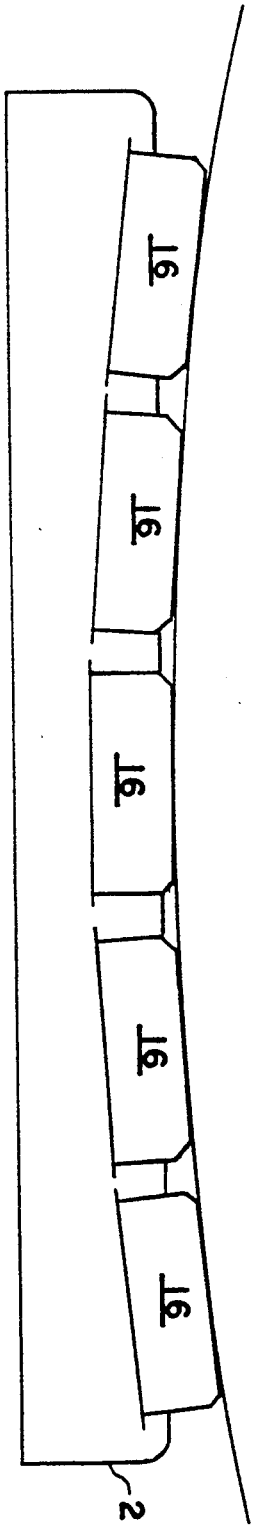
FIG. 7 is a side elevational diagrammatic view of a portion of the razor in operation against a convex surface.
Figure 9:
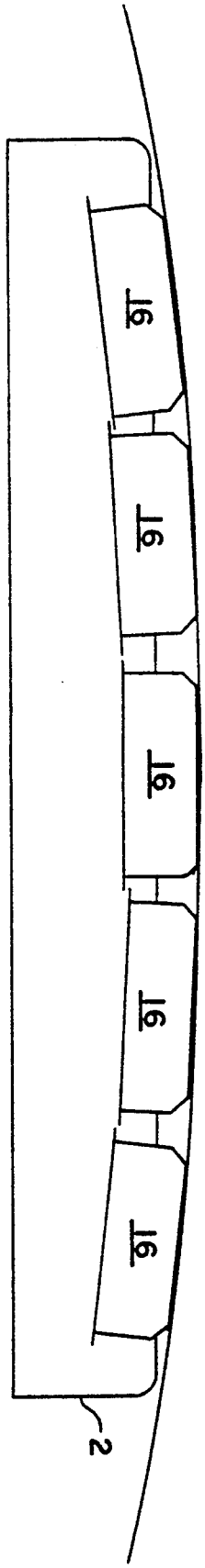
FIG. 9 is a side elevational diagrammatic view similar to FIG. 7, but showing the razor in operation against a concave surface.

Accordingly, the razor herein described is well suited for shaving underarms (FIGS. 9 and 10) and legs (FIGS. 7 and 8).

Inasmuch as the housing 2, the base member 12, and the blades 16 are impervious to water, there is no sponge-like absorption of water and, therefore, no undesirable release of water when the razor is pressed against a shaving surface. Further, the razor herein described is easily rinsed and kept clean and free of shaving debris. The alignment of the holes 10 and 17 permits a flow of water from a faucet to pass through the blades 16, the housing 2, and the base member 12, carrying away any debris which may have accumulated interiorly of the housing or the blades. The housing may be provided with slots 62 (FIG. 5) between the ribs 8 to provide additional channels for the flow of water through the housing, as well as circulation of air for drying purposes.

It is to be understood that the present invention is by no means limited to the particular construction herein disclosed and/or shown in the drawings, but also comprises any modifications or equivalents within the scope of the claims.

Having thus described my invention, what I claim as new and desire to secure by Letters Patent of the United States is:

1. A razor comprising a tubular blade, a base member, resilient fingers upstanding from said base member and extending into said tubular blade, said fingers being adapted to flex inwardly toward each other upon application of pressure against said blade to permit said blade to move on said fingers in a direction toward said base member.

2. The razor according to claim 1, further including rigid protrusions upstanding from said base member and of lesser height than said resilient fingers, said protrusions having end surfaces adapted to engage said blade to limit said movement of said blade toward said base member.

3. The razor according to claim 2 in which said resilient fingers are each provided with an outboard edge inclined from a free end to a relatively broader base portion, said blade being engaged by said outboard edges, said blade being adapted to move toward said free ends of said resilient fingers in response to a bias of said resilient fingers to move to an unstressed position.

4. The razor according to claim 3 and further including a housing having a hole therein, said tubular blade being disposed in said housing hole and tiltingly and reciprocally movable therein on said resilient fingers.

5. The razor in accordance with claim 4 in which said base member is disposed in said housing.

6. The razor in accordance with claim 5 in which said base member is provided with a hole therein aligned with said housing hole, said resilient fingers and said rigid protrusions being arranged around the periphery of said base member hole.

7. A razor comprising a base member, resilient protrusions extending from said base member, razor blades mounted on said resilient protrusions, each of said razor blades having a generally tubular wall defining a central aperture and an integrally formed first flange on a first end of said tubular wall, said first flange having at a free edge thereof an annular cutting edge, said resilient protrusion extending into second ends of said tubular walls, whereby said resilient protrusions within said tubular walls permit movement of said razor blades responsive to pressures encountered during shaving operations.

8. The razor in accordance with claim 7 in which said base member is formed of an elastomeric material and said resilient protrusions are formed integrally with, and as extensions of, said base member.

9. The razor in accordance with claim 7 and further including a housing having a top wall disposed generally parallel to and removed from said base member, said top wall having holes therein, said blades being disposed in said holes.

10. The razor in accordance with claim 9 in which said blades are each provided with an integrally formed second flange at said second end thereof, said second flange extending outwardly from said tubular wall, said second flange being adapted to abut an underside of said top wall of said housing.

11. The razor in accordance with claim 7 in which said first flange extends inwardly from said tubular wall and said annular cutting edge is inwardly directed.

12. The razor in accordance with claim 7 in which said resilient protrusions comprise spring fingers.

13. The razor in accordance with claim 12 in which said base member is formed of an elastomeric material and said spring fingers are formed integrally with said base member.

14. The razor in accordance with claim 13 in which said material is impervious to water.

15. The razor in accordance with claim 12 in which a plurality of said spring fingers extend into said aperture of said blade tubular wall.

16. The razor in accordance with claim 15 and further including rigid protrusions extending from said base member, said rigid protrusions being proximate said spring fingers and of less height than said spring fingers, said rigid protrusions having end surfaces adapted to engage said blades to limit movement of said blades in a direction toward said base member.

17. The razor in accordance with claim 16 in which said spring fingers are adapted to flex inwardly toward each other to permit said movement of said blades toward said base member.

18. The razor in accordance with claim 17 in which each of said spring fingers has an outboard edge inclined from a free end of said spring finger outwardly to a relatively broader base of said spring finger, said blades being engaged by said inclined spring finger edges, said blades being adapted to move along said edges in a direction toward said spring finger free ends in response to said spring fingers flexing outwardly to regain their unstressed positions.

19. The razor in accordance with claim 18 and further including a housing having a top wall disposed generally parallel to and removed from said base member, said top wall having holes therein, said blades being disposed in said holes.

20. The razor in accordance with claim 19 in which said blades are each provided with a second flange extending outwardly from said tubular wall, said second flange being adapted to abut an underside of said top wall of said housing to limit said movement of said blades on said spring fingers toward said spring fingers free ends.

21. The razor in accordance with claim 20 in which said spring fingers and said rigid protrusions are formed integrally with said base member and are of configurations which render said spring fingers substantially resilient and said protrusions substantially rigid.

22. The razor in accordance with claim 16 in which said base member is provided with holes aligned with said housing holes, and said spring fingers and rigid protrusions are disposed in alternating fashion around said base member holes.

23. A razor blade support means for supporting tubular razor blades, said support means comprising a base member having a top wall and depending side walls, said top wall having holes therein, and protrusions upstanding from said top wall and disposed around said holes, said protrusions comprising resilient fingers and rigid protrusions, said base member being of a molded plastic material and said protrusions being molded integrally with said base member.

24. The razor blade support means in accordance with claim 23 in which said resilient fingers are longer and more slender than said rigid protrusions.

25. The razor blade support means in accordance with claim 24 in which said top wall is provided with a first row of said holes wherein said first row of holes are disposed in a line proximate a first side wall of said base member, a second row of said holes wherein said second row of holes are disposed in a line proximate a second side wall of said base member, said second row of holes being aligned with said first row of holes sidewise of said top wall, and a third row of said holes between said first and second row of said holes, said third row of holes being offset from said holes of said first and second rows, such that said holes of said third row are at least in part disposed in paths between said holes of said first and second rows widthwise of said base member.

26. The razor blade support means in accordance with claim 25 in which said rigid protrusions include Y-shaped protrusions each adjacent three of said holes, and two-legged angled protrusions each adjacent two of said holes.

27. The razor blade support means in accordance with claim 26 in which said resilient fingers are adapted to have said razor blades mounted thereon, and said rigid protrusions are provided with flat free ends adapted to receive ends of said blades to limit movement of said blades along said resilient fingers.

28. The razor blade support means in accordance with claim 27 in which said resilient fingers and said rigid protrusions are arranged alternately around said holes.

* * * * *